United States Patent [19]

Despot et al.

[11] 3,972,524

[45] Aug. 3, 1976

[54] SHEET INTERCEPT MECHANISM TO PERMIT REMOVAL OF DELIVERY PILE IN PRINTING PRESS

[75] Inventors: Janko Despot; Claus Simeth, both of Offenbach, Germany

[73] Assignee: Roland Offsetmaschinenfabrik Faber & Schleicher AG, Germany

[22] Filed: Aug. 20, 1975

[21] Appl. No.: 606,083

[30] Foreign Application Priority Data

Aug. 29, 1974 Germany ..... 2441459

[52] U.S. Cl. ..... 271/218; 271/189

[51] Int. Cl.[2] ..... B65H 31/32

[58] Field of Search ..... 271/157–159, 271/189, 218; 214/6 DK

[56] References Cited

UNITED STATES PATENTS

| | | | |
|---|---|---|---|
| 2,113,650 | 4/1938 | Golber | 271/189 |
| 2,847,215 | 8/1958 | Koch | 271/218 |
| 2,950,108 | 8/1960 | Golding | 271/189 |

*Primary Examiner*—John J. Love
*Assistant Examiner*—Robert Saifer
*Attorney, Agent, or Firm*—Leydig, Voit, Osann, Mayer & Holt, Ltd.

[57] ABSTRACT

A sheet intercept mechanism for temporarily retaining sheets released by the take-off grippers above a delivery pile at the output of a sheet fed printing press. The mechanism includes a horizontal support member and a clamping member normally in open position but having means for closing to capture the edge of a dropped sheet. A horizontal actuator coupled to the support member advances it to a sheet receiving position above the edge of the pile. Triggering means are provided coupled to the take-off grippers for closing the clamping member phased with the release of a sheet so that the clamping member clamps the dropped sheet preventing it, and any subsequently dropped sheet, from dropping upon the pile so as to permit the pile to be removed and a new pile board inserted. The triggering means is disabled as long as the horizontal support is in its retracted position and enabled only when the support is in sheet receiving position. Means are included for energizing the actuator for return of the support into its retracted position accompanied by stripping of the retained sheets so that they are free to drop upon the inserted pile board and for opening the clamping member in readiness for a new retention cycle.

12 Claims, 4 Drawing Figures

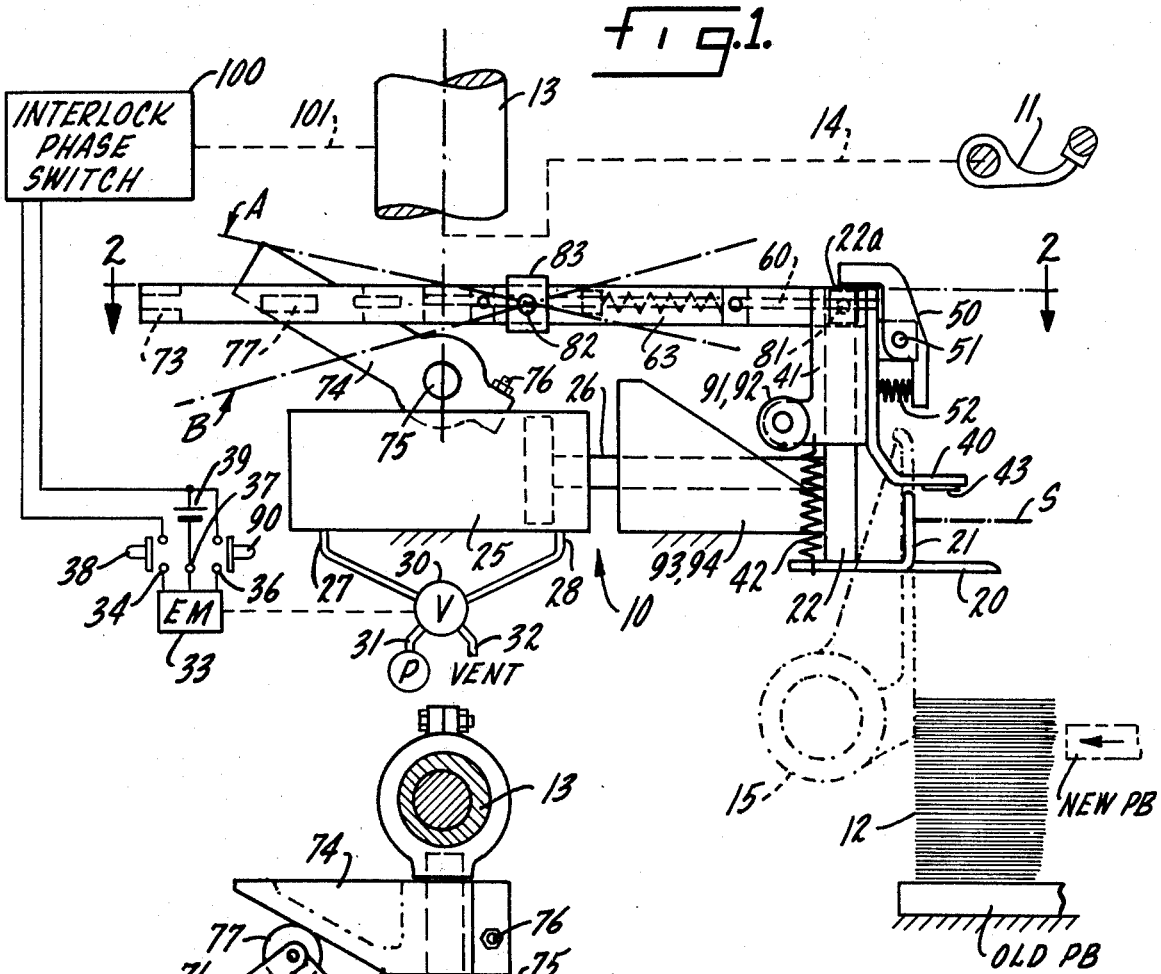
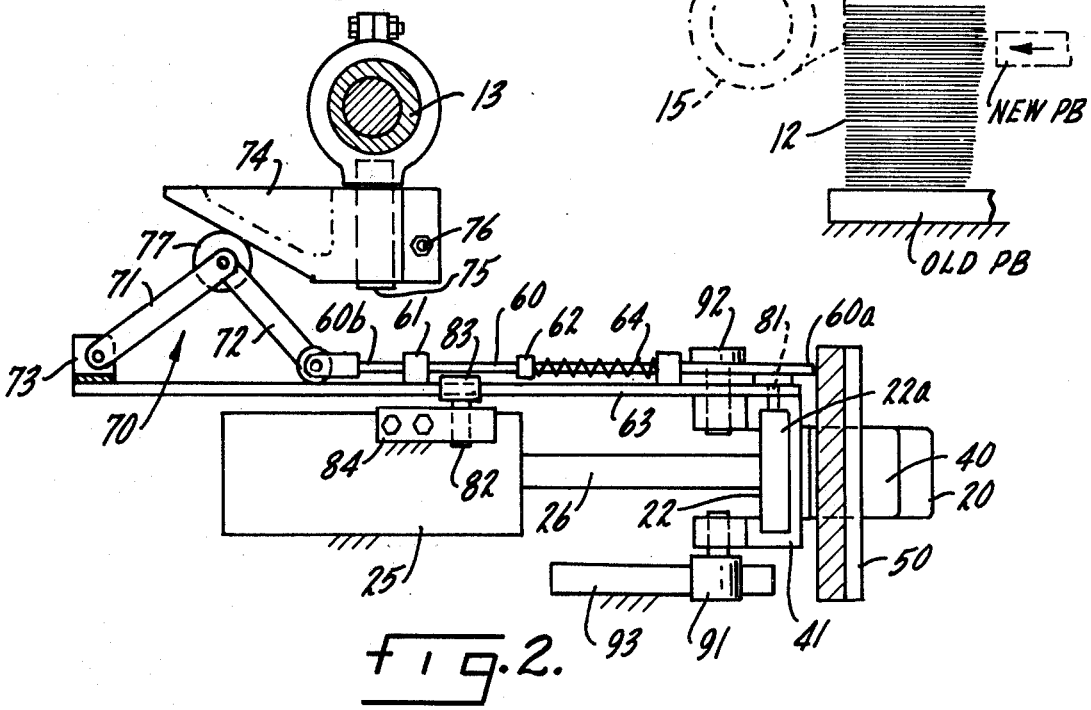
fig.2.

SHEET INTERCEPT MECHANISM TO PERMIT REMOVAL OF DELIVERY PILE IN PRINTING PRESS

For consistent high quality printing, and for reasons of economy, it is desirable to operate a sheet fed press continuously once it is started. This means that some means must be provided for temporarily intercepting the sheets which are dropped in succession upon a delivery pile so as to permit the pile to be removed and a new pile board inserted.

Such interception has been accomplished in various ways. In German Pat. No. 921,154, by way of example, the arriving sheets are gasped by suction grippers and are transferred to retaining suckers that retain sheets until the new pile board has been inserted in receiving position, following which the suckers are deenergized. One disadvantage of this arrangement is that the suckers are limited in the number of sheets which can be accumulated. In another device of this type, exemplified by German disclosure specification 2,218,535, grippers are interposed for intercepting a falling sheet, the grippers being operated by hand levers and mechanical linkage. Such a device, lacking any mechanical synchronization, requires a high degree of skill on the part of the operator and success is not uniform.

It is therefore an object of the present invention to provide a sheet intercept mechanism which is reliable, simple, and trouble-free and which overcomes the disadvantages of known devices of this kind.

It is a more specific object of the invention to provide a sheet intercept mechanism for a printing press delivery pile which has means for prompt interposition above the pile together with means for closing a clamping member phased with the dropping of the sheet for positively engaging the edge of the sheet to provide temporary support of the sheet and for any subsequently deposited sheets, permitting the delivery pile to be removed and a new delivery board to be substituted therefor.

It is an object of the invention to provide intercept means which is not limited in the number of sheets which can be intercepted, with the subsequently dropped sheets simply being collected upon the captive sheet so that the pile may be removed and a new board substituted in a more deliberate and leisurely manner than has been possible in the past. It is a related object to provide a sheet intercept mechanism which is capable of reliable operation with the most modern presses having a high drop rate while providing adequate time for orderly substitution of a new pile board.

In short, it is an object of the invention to provide a sheet intercept mechanism for a delivery pile which is foolproof and which may be easily and capably operated even by a person having no particular skill or experience, with all of the critical timing functions being directly under the automatic control of the take-off grippers, that is to say, the press mechanism.

Other objects and advantages of the invention will become apparent upon reading the attached description and upon reference to the drawings in which:

FIG. 1 is a diagrammatic elevational view of a sheet intercept mechanism constructed in accordance with the present invention and showing the mechanism following advancement of the support member into position above the edge of the pile but prior to triggering of the associated clamping member;

FIG. 2 is a diagrammatic top view corresponding to FIG. 1 taken on line 2—2 in FIG. 1;

Figure 3:
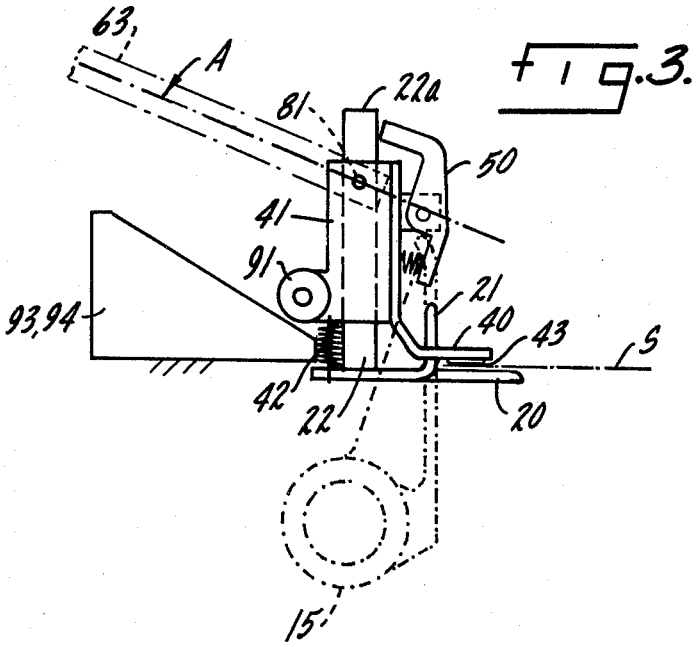
FIG. 3 is a stop motion diagram showing the triggering of the clamping member into engagement with the edge of a retained sheet and the resulting tilt of the follower lever.

While the invention has been described in connection with a preferred embodiment, it will be understood that we do not intend to be limited to the embodiment shown but intend, on the contrary, to cover the various alternative and equivalent forms of the invention including within the spirit and scope of the appended claims.

Turning now to the drawings, there is shown a sheet intercept mechanism 10 interposed between take-off grippers 11 and a pile 12. During normal operation of the press (not shown), printed sheets are conveyed by grippers 11 to a point of release where the grippers are operated by a shaft 13 via a connection 14 to drop the conveyed sheets, one by one, on the top of the delivery pile. As the sheets fall they have a slight forward component of movement and the leading edge of the sheet is positioned by striking a vertically extending guide or "jogger" 15 at the front of the pile.

In accordance with the present invention, a horizontal support member and cooperating clamping member are interposed above the edge of the pile and the clamping member is triggered by operation of the take-off gripper so as to close upon, and thus intercept, a sheet S at a position above the pile 12. Since the leading edge of the sheet is securely held captive by the clamping member, any sheets which are subsequently dropped simply collect on top of the captive sheet and are prevented from reaching the pile. This provides opportunity for the press operator to remove the pile and to substitute a new pile board PB adjacent the jogger and in the path of movement of the sheets, following which the support member with its clamping membere are retracted clear of the pile, the intercepted sheets being stripped therefrom by the jogger for depositing upon the pile board for the starting of a new pile. Thus we provide a supporting member 20 in the form of a ledge having an associated stop 21 arranged at right angles thereto, the member and its stop both being connected to a vertical post 22. For moving the supporting member 20 from a retracted position to the illustrated sheet-receiving position along a path of movement adjacent the jogger 15, a horizontal actuator 25 is provided having a plunger 26, the post 22 on the supporting member being connected to the forward end of the plunger. The actuator 25 is preferably in the form of a stationary pneumatic cylinder of the double acting type having ports 27, 28 at its respective ends. For pressurizing the actuator for movement in its opposite directions a four-way valve 30 is provided connected to a source of pressure 31 and having a vent 32. The valve is switched between its two states by means of a two-position electromagnet 33 having a "forward" terminal 34 and a "retract" terminal 36 as well as a common terminal 37. It will suffice for the moment to state that forward movement of the supporting member is obtained by push button 38 which furnishes current from a suitable source 39. It will be assumed that the push button 38 has been pressed causing the actuator port 27 to be pressurized so that the supporting member 20 occupies its intercepting position.

For the purpose of gripping the intercepted sheet, a clamping member 40 is provided mounted upon a slide 41 which has a telescoping connection with the post 22 forming a part of the supporting member. In the present instance the clamping member is urged into closed position by a tension spring 42. Secured to the clamping member is a resilient pad 43. The material of the pad and the tension exerted by the spring in clamping condition are so chosen that the applied force is high enough for reliable sheet retention, yet low enough to permit "stripping", as will be described. To hold the clamping member open against the force of bias, a latch 50 is provided having a pivot connection 51 to the clamping member and normally retained in latching position by means of the spring 52. The latch is positioned to normally overlie the upper end 22*a* of the post 22, preventing the clamping member from descending.

In carrying out the present invention a trigger is provided for releasing the latch, for descent of the clamping member, at a moment which is phased with the operation of the take-off grippers 11. The trigger is in the form of a triggering rod, or push rod, 60, which is slidable endwise in guides 61, 62 mounted upon a follower lever 63. The push rod 60 is normally retained in the illustrated retracted state by means of a biasing spring 64. Thus, under normal conditions, the tip of the push rod 60, and which is indicated at 60*a*, is clear of the latch 50.

For the purpose of advancing the push rod 60 in a triggering direction, that is to the right, at a particular phase position of the gripper shaft 13, the left-hand end 60*b* of the rod is connected to a scissor type linkage 70 formed of a first link 71 and a second link 72, the first link being anchored to a bracket 73 at the left-hand end of the follower lever. The linkage 70 is actuated by a cam in the form of an arm 74 mounted upon a stub shaft 75 which extends radially from the gripper shaft 13 and upon which the arm is held in adjusted position by a clamping screw 76. A cam follower roller 77 connected at the junction of the links 71, 72 is in the path of movement of the arm 74. As a result when the shaft 13 is rocked counterclockwise into a predetermined phase position, the links 71, 72 are spread, advancing the push rod 60 sufficiently to disengage the latch 50 from the upper end 22*a* of the post 22 on the support member, triggering the descent of the clamping member 40 to clamp the edge of the sheet.

In accordance with one of the aspects of the present invention means are provided for disabling the trigger during the time that the support member 20 is retracted away from the pile and for enabling the operation of the trigger after the support member has been advanced to a position over the edge of the pile. In the present instance this is accomplished by interconnecting the front end of the follower lever 63 by a pivot to the upper end of the slide 41 of the clamping member 40 and by pivoting the central portion of the lever for rocking, with respect to the frame of the device teeter-totter fashion, while at the same time permitting relative sliding movement of the lever with respect to the frame to accommodate the horizontal motion of the actuator 25. Thus referring to the drawing, the follower lever 63 has a pivot connection 81 with the upper end of the slide 41 and a central fulcrum 82 to permit bodily rocking movement. The fulcrum 82 is provided by a slide 83 which supports the lever 63 while accommodating endwise sliding movement, the slide being pivoted to a fixed bracket 84. As will be seen in FIG. 1, when the supporting member 20 is thrust into its active sheet-receiving position, the lever is positioned so that the follower roller 77 is in the path of movement of the arm 74 on the take-off gripper shaft. Thus the rocking movement of the shaft 13 is "enabled" to operate the linkage 70 to move the push rod 60 endwise to trigger the latch 50, permitting the clamping member 40 to descend, as illustrated in FIG. 3, for capturing the edge of the dropped sheet S. For optimum alinement, or register, between the arm 74 and follower 77 when follower lever 63 is in its horizontal position, the clamping screw 76 may be loosened and the arm rocked a small amount in one direction or the other about the supporting stub shaft 75.

It will be seen that, because of the teeter-totter action of the follower lever 63, the cam follower roller 77 is, at other times, out of the path of movement of the arm 74, thereby disabling the trigger. Thus after the clamping member 40 has been triggered and occupies its lowermost position, illustrated in FIG. 3, the orientation of the follower lever 63 is shown by the dot-dash line A so that the follower roller 77, which moves with the lever, is out of the path of movement of the arm 74, being above the level of the arm 74. Conversely, when the device is in its "rest" position, the lever 63 is rocked counterclockwise, as will be seen, to position B in which the follower roller 77 is again out of the path of movement of the arm 74, being then too low to be acted upon by the arm. In short, the trigger 60 and its linkage 70 are active, or "enabled" only when the mechanism is in the condition illustrated in FIG. 1.

Further in accordance with the invention, means are provided, after successful interception, for retracting the supporting member 20 to strip the intercepted sheets, for raising the clamping member 40 to open position, and for resetting the latch 50. Retraction of the supporting member 20 is accomplished by reversely energizing the actuator 25. This is done by pressing the alternate push button 90 which causes current to flow through the electromagnet 33 in the reverse sense from the source 39 thereby setting the valve 30 to provide pressure at inlet port 28 to retract the plunger 26.

As the support member and clamping member begin to move together into retracted position, the intercepted sheet S, and any subsequently dropped sheets which may be superimposed thereon, are "stripped" off by the jogger 15, with the sheets dropping downwardly upon the pile board PB in register position to start a new pile.

For subsequently raising the clamping member 40 incident to such retraction, and resetting the latch, rollers 91, 92 are provided on the slide 41 of the clamping member and which are acted upon by stationarily mounted reset ramps 93, 94 respectively (only one of which is shown). It will be apparent that the ramps and rollers thus act as auxiliary cams followers: As the support member 20 and its associated clamping member 40 are moved to the left, engagement of the rollers 91, 92 with respective ramps 93, 94 causes the slide 41 to be cammed upwardly (see FIG. 4), accompanied by counterclockwise rocking of the following lever 63, until the latch 50 at the right-hand end thereof clears the end 22*a* of the bar 22, causing the latch to be reset in its original position in readiness for an ensuing retention cycle.

While it is one of the important features of the invention that the trigger 60 which releases the clamping member 40 is accurately phased with respect to the gripper shaft 13, means are preferably also provided for accurate mechanical phasing of the moment of advancement of the supporting member 20 into its intercepting position. This is accomplished by providing an auxiliary interlock phase switch 100 in series with the push button 38, the phase switch having a mechanical connection 101 to the shaft 13. Such mechanical connection may, for example, be in the form of a cam (not shown) mounted upon the shaft or the mechanical connection may be interposed in the path of movement of the grippers so that the supporting member is interposed upon arrival of a set of grippers.

Figure 4:
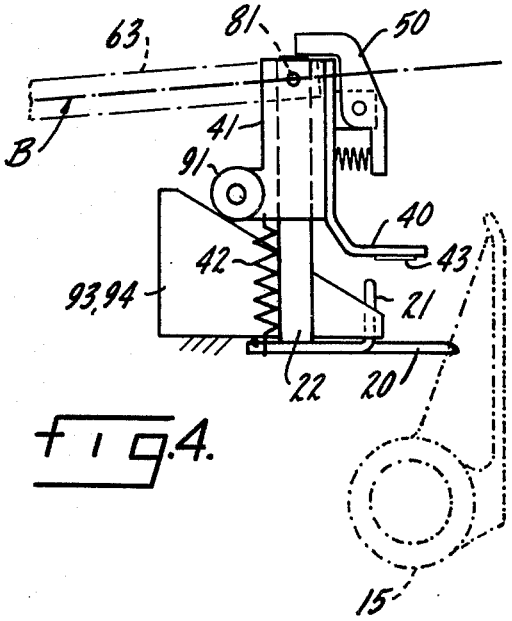
FIG. 4 is a further stop motion view showing resetting of the latch in readiness for an ensuing retention cycle accompanied by opposite tilting of the follower lever.

Having understood the construction of the mechanism and the means for controlling the mechanism, a typical cycle of operation may be considered:

It is assumed that the pile 12 has reached a height requiring removal and substitution of a new pile board. It will further be assumed that the supporting member 20 is in its retracted position clear of the pile, with the clamping member 40 raised, and the latch 50 set, as illustrated in FIG. 4.

To initiate an operating cycle push button 38 is pressed and momentarily held in. When the gripper shaft 13 reaches a predetermined first phase position, or alternatively when the grippers arrive, switch 100 closes, energizing electromagnet 33 to pressurize the actuator 25 for thrusting of the supporting member 20 to the right into intercepting position above the edge of the pile 12. As the supporting member moves to the right, the rollers 91, 92 roll down and then leave their respective ramps accompanied by clockwise rocking of the follower lever 63 from position B to the position illustrated in FIG. 1, in which lever 63 is horizontal, thereby positioning the follower roller 77 in the path of the movement of arm 74. Upon rocking of the arm 74 against the follower roller 77 to trap the sheet, the shaft 13 reaches a second phase position which is effective to advance the push rod to the point of unseating the latch 50 so that the clamping member 40 is free to snap downwardly under the urging of biasing spring 42. By properly phasing the advancement of the supporting member into its receiving position, it is in readiness to receive the dropped sheet which is then promptly captured by the phase triggering of the clamping member 40 (FIG. 3). Downward movement of the clamping member 40 performs the additional function of rocking the lever 63 clockwise into position A, thereby moving the follower roller 77 upwardly out of the influence of the arm 74 so that the trigger, which is no longer needed, is disabled. Since the first sheet is reliably captive any subsequent sheets, falling upon the first sheet are also reliably intercepted. In addition, all such sheets are accurately positioned by the stop surface 21. Since a relatively large number of subsequently dropping sheets can be accommodated, the pressman has more than enough time to remove the pile 21 and to insert a new pile board PB, even where sheets are being delivered from a press having a high production rate. Thus replacement of the pile with a new pile board may be done carefully and deliberately rather than in the hurried fashion required by more conventional intercepting devices which are limited in the number of sheets that can be successfully intercepted.

With the new pile board safely in place, and with the jogger restored to the illustrated position, the push button 90 is pressed to retract the actuator 25, causing the support 20 and clamping member 40 to be retracted rearwardly past the jogger, with the jogger thus serving to strip the sheets clear of their temporary support so that they fall straight down in registered position upon the pile board to start a new pile. The rollers 91, 92 are cammed upwardly by the reset ramps, raising the clamping member 40, resetting the latch 50, and rocking the follower lever 63 counterclockwise, all as illustrated in FIG. 4. With the follower lever in its B position, the follower 77 is out of the path of cyclical movement of the arm 74 so that the trigger is in a disabled state. The mechanism is thus placed in a "rest" condition, safely clear of the pile so that it does not interfere with the normal dropping of sheets and is in readiness for the starting of a new cycle upon pressing of the push button 38.

It will be apparent that the objects of the invention have been amply carried out. The operation of the device is mechanically positive at all delivery speeds, sheets can be intercepted in sufficient number to permit deliverate pile removal and, most important of all, operation is automatic and does not require any experience or dexterity on the part of the press operator.

The term "horizontal" as applied to the actuator 25 has to do with its direction of movement. If desired, a two position electromagnet analogous to that used to operate the pneumatic valve may be used to act upon the supporting member directly to shift it between its two positions. The reference to the clamping member being "vertically movable" on the support members refers to relative movement, since either one or both of the members may be movable for clamping purposes without departing from the invention. With regard to the triggering means being "coupled to the take-off grippers", it will be understood that such coupling means may be direct, as shown, or indirect, as where coupling is made to some other element of the press drive which is in phased relation to the grippers. By phased relation is meant a constant phase difference.

While only a single mechanism 10, at the leading edge of the sheet, has been described, it will be understood that a second such mechanism, in mirror image, may be provided at substantially the same height at the trailing edge and triggered substantially in unison to provide full sheet support.

What is claimed is:

1. A sheet intercept mechanism for temporarily retaining sheets by take-off grippers above a delivery pile at the output of a sheet fed printing press comprising, in combination, a horizontal supporting member, a clamping member vertically movable thereon, a horizontal actuator coupled to the supporting member for advancing it forwardly from a retracted position clear of the pile into a sheet receiving position above the edge of the pile, means for biasing the clamping member downwardly into engagement with the supporting member, a latch for holding the clamping member upwardly against the force of bias, means for energizing the actuator for forward movement, triggering means coupled to take-off grippers for operation thereby phased with release of a dropped sheet for triggering the latch so that the clamping member clamps the edge of the dropped sheet to the supporting member to intercept the dropped sheet as well as sheets subsequently dropped, thereby to permit the pile to be removed and a new pile board inserted in the place thereof, the triggering means having disabling means for disabling the triggering means when the horizontal support member is in its retracted position and for enabling the triggering means when the support member is in its receiving position, means for subsequently energizing the actuator for movement of the supporting member back into retracted position, a vertical stripping member aligned with the edge of the pile for stripping the intercepted sheets from between the supporting member and the clamping member so that such sheets are deposited on the pile board in registered position to begin a new pile, and restoring means operated incident to the retraction of the support member for raising the clamping member and resetting the latch in readiness for an ensuing interception cycle.

2. The combination as claimed in claim 1 in which the triggering means includes a cam coupled to the take-off grippers and a cooperating cam follower coupled to the latch.

3. The combination as claimed in claim 2 in which the cam follower is coupled to the clamping member for positioning movement therewith so that the follower is in register with the cam for operation thereby when the support member is in its sheet-receiving position but is out of register with the cam when the support member is not in its sheet-receiving position for thereby disabling the cam follower.

4. The combination as claimed in claim 3 in which a follower lever is provided for supporting the cam follower, the follower lever being coupled at one end to the clamping member.

5. The combination as claimed in claim 3 in which the cam is in the form of a rockable arm coupled to the take-off grippers and in which the arm is adjustable in position to insure register with the cam follower when the support member is in its sheet-receiving position.

6. The combination as claimed in claim 1 in which the restoring means includes an auxiliary cam and cam follower for camming the clamping member upwardly incident to movement of the supporting member back into retracted position.

7. A sheet intercept mechanism for temporarily retaining sheets released by take-off grippers above a delivery pile at the output of a sheet fed printing press comprising in combination a horizontal supporting member, a clamping member vertically movable thereon, a horizontal actuator coupled to the supporting member for advancing it forwardly from a retracted position clear of the pile into a sheet-receiving position above the edge of the pile, the clamping member being in normally open condition having means for relatively closing the members for clamping the edge of a sheet between them, means for energizing the actuator for forward movement into sheet-receiving position, triggering means coupled to the take-off grippers for operation thereby phased with release of a dropped sheet for triggering the closing means so that the clamping member clamps the edge of the dropped sheet to the supporting member for intercepting the dropped sheet as well as the sheets subsequently dropped, thereby to permit the pile to be removed and a new pile board inserted in the place thereof, the triggering means having disabling means for disabling the triggering means when the horizontal support member is in its retracted position and for enabling the triggering means when the supporting member is in its sheet receiving position, means for subsequently energizing the horizontal actuator for movement of the supporting member back into retracted position, means operated incident to retraction of the supporting member for releasing the intercepted sheets so that the sheets are deposited on the pile board to begin a new pile, and means for restoring the clamping member to its normal open position in readiness for an ensuing interception cycle.

8. The combination as claimed in claim 7 in which the horizontal actuator is in the form of a pneumatic cylinder having a plunger connected to the support member and having means for manually controlling flow of air to the cylinder for shifting of the plunger between limit positions.

9. The combination as claimed in claim 7 in which the actuator has means for initiating forward movement and initiating retracting movement and in which the means for initiating forward movement includes an interlock phase switch coupled to the take-off grippers to insure that the supporting member is interposed in its sheet-receiving position at a time which is properly phased with respect to the dropping of a sheet by the grippers.

10. The combination as claimed in claim 7 in which the support member is in the form of a horizontal ledge having a vertical stop surface at the right angles thereto for engaging the leading edge of the intercepted sheets for registering the same.

11. The combination as claimed in claim 7 in which the releasing means is in the form of a jogger engaging the front edge of the pile and in which the force exerted by the clamping member is sufficiently high as to enable reliable support of the intercepted sheets yet sufficiently low so that when the supporting member is retracted with the clamping member in clamped condition, the intercepted sheets are stripped from the supporting member and deposited on the pile board in registered position to begin a new pile.

12. A sheet intercept mechanism for temporarily retaining sheets released by take-off grippers above a delivery pile at the output of a sheet fed printing press comprising, in combination, a horizontal supporting member, a clamping member vertically movable thereon, a horizontal actuator coupled to the supporting member for advancing it forwardly from a retracted position clear of the pile into a sheet-receiving position above the edge of the pile, the clamping member being in normally open condition and having means for relatively closing the members for clamping the edge of a sheet between them, means for energizing the actuator for forward movement into sheet-receiving position, triggering means for triggering the closing means, means operated at a first phase position of the grippers for energizing the horizontal actuator for interposition of the supporting member into receiving position, and means operated at a second phase position of the grippers for energizing the triggering means timed with arrival of a dropped sheet so that the clamping member clamps the edge of the dropped sheet to the supporting member for intercepting the dropped sheet as well as the sheets subsequently dropped, thereby to permit the pile to be removed and a new pile board inserted in the place thereof, means for subsequently energizing the horizontal actuator for movement of the supporting member back into retracted position, and means operated incident to movement of the supporting member for releasing the intercepted sheets so that the sheets are deposited on the pile board to begin a new pile, and means for restoring the clamping member to its normal open position in readiness for an ensuing interception cycle.

* * * * *